US009664060B2

(12) United States Patent
Inoue et al.

(10) Patent No.: US 9,664,060 B2
(45) Date of Patent: May 30, 2017

(54) VARIABLE NOZZLE UNIT AND VARIABLE GEOMETRY SYSTEM TURBOCHARGER

(71) Applicant: IHI Corporation, Koto-ku (JP)

(72) Inventors: Tomohiro Inoue, Tokyo (JP); Takao Asakawa, Tokyo (JP); Kenichi Segawa, Tokyo (JP)

(73) Assignee: IHI Corporation, Koto-ku (JP)

( * ) Notice: Subject to any disclaimer, the term of this patent is extended or adjusted under 35 U.S.C. 154(b) by 574 days.

(21) Appl. No.: 14/187,477

(22) Filed: Feb. 24, 2014

(65) Prior Publication Data

US 2014/0248137 A1 Sep. 4, 2014

(30) Foreign Application Priority Data

Mar. 1, 2013 (JP) ..... 2013-040728
Mar. 1, 2013 (JP) ..... 2013-040744

(51) Int. Cl.
*F01D 17/16* (2006.01)

(52) U.S. Cl.
CPC ..... *F01D 17/16* (2013.01); *F01D 17/165* (2013.01)

(58) Field of Classification Search
CPC ..... F01D 17/16; F01D 17/165; F02B 37/24
USPC ..... 415/164, 163
See application file for complete search history.

(56) References Cited

U.S. PATENT DOCUMENTS 4,629,396 A * 12/1986 Lorett ..... F01D 17/165 415/164
4,804,316 A * 2/1989 Fleury ..... F01D 17/165 415/134
7,001,142 B2 * 2/2006 Knauer ..... F01D 17/165 415/160
7,509,804 B2 * 3/2009 Kobayashi ..... F01D 17/165 415/158
8,807,926 B2 * 8/2014 Nagao ..... F01D 5/141 415/158
8,932,008 B2 1/2015 Boening et al.
9,121,300 B2 9/2015 Matsuyama
2010/0310363 A1 12/2010 Matsuyama et al.
2011/0027074 A1 2/2011 Boening et al.
(Continued)

FOREIGN PATENT DOCUMENTS

CN 101896705 A 11/2010
CN 101999046 A 3/2011
JP 2003-27951 A 1/2003
(Continued)

OTHER PUBLICATIONS

Combined Chinese Office Action and Search Report issued Jan. 5, 2016 in Patent Application No. 201410064768.5 (with English translation of categories of cited documents).
(Continued)

*Primary Examiner* — Christopher Verdier
*Assistant Examiner* — Brian O Peters
(74) *Attorney, Agent, or Firm* — Oblon, McClelland, Maier & Neustadt, L.L.P.

(57) ABSTRACT

A variable geometry system turbocharger includes a variable nozzle unit, which is disposed in a turbine housing by being sandwiched between the turbine housing and a bearing housing, and which adjusts a passage area for the exhaust gas to be supplied to a turbine impeller. The bearing housing includes a container recessed portion which contains a link mechanism of the variable nozzle unit.

9 Claims, 8 Drawing Sheets

(56) References Cited

U.S. PATENT DOCUMENTS

2012/0237343 A1 9/2012 Matsuyama

FOREIGN PATENT DOCUMENTS

| | | | |
|---|---|---|---|
| JP | 2006-194176 | A | 7/2006 |
| JP | 2009-74492 | A | 4/2009 |
| JP | 2009-144545 | A | 7/2009 |
| JP | 2009-243300 | | 10/2009 |
| JP | 2009-243431 | | 10/2009 |
| JP | 2010-196653 | | 9/2010 |
| JP | 2010-203239 | | 9/2010 |
| JP | 2010-229908 | A | 10/2010 |
| JP | 2011-85054 | A | 4/2011 |
| WO | WO 2010/097980 | A1 | 9/2010 |
| WO | WO 2011/074039 | A1 | 6/2011 |
| WO | WO 2011/137984 | A1 | 11/2011 |

OTHER PUBLICATIONS

U.S. Appl. No. 14/178,683, filed Feb. 12, 2014, Inoue, et al.
Japanese Office Action issued Jan. 10, 2017 in patent application No. 2013-040728.
Office Action issued Nov. 1, 2016 in Japanese Patent Application No. 2013-040744.
Office Action issued Oct. 18, 2016 in Japanese Patent Application No. 2013-040728.

* cited by examiner

VARIABLE NOZZLE UNIT AND VARIABLE GEOMETRY SYSTEM TURBOCHARGER

BACKGROUND OF THE INVENTION

Field of the Invention

The present invention relates to a variable nozzle unit configured to adjust a passage area for (or a flow rate of) an exhaust gas to be supplied to a turbine impeller side in a variable geometry system turbocharger, and a variable geometry system turbocharger equipped with the variable nozzle unit and configured to supercharge air to be supplied to an engine side by using energy of an exhaust gas from the engine.

Description of the Related Art

In recent years, various developments have been made with regard to a variable nozzle unit to be disposed in a turbine housing in a variable geometry system turbocharger by being sandwiched between (fastened by) the turbine housing and a bearing housing. An essential configuration of variable nozzle units disclosed in Japanese Patent Application Publications No. 2009-243431 (Patent Document 1) and No. 2009-243300 (Patent Document 2) is as follows.

A turbine housing rotatably houses a turbine impeller. The turbine housing includes a turbine scroll passage which supplies an exhaust gas to the turbine impeller. Between the turbine scroll passage and the turbine impeller, a first base ring is disposed concentrically with the turbine impeller. A second base ring is provided at a position away from the first base ring in an axial direction of the turbine impeller. The second base ring is integrated with the first base ring by use of connecting pins.

Multiple variable nozzles are provided between facing surfaces of the first base ring and the second base ring. The multiple variable nozzles are disposed at equal intervals in a circumferential direction of the turbine impeller in such a manner as to surround the turbine impeller. Each variable nozzle is provided rotatably in a forward direction or a reverse direction (in an opening direction or a closing direction) about its pivot which is parallel to a pivot of the turbine impeller. In addition, a link mechanism is disposed on an opposite surface side of the first base ring from the facing surface. The link mechanism causes the multiple variable nozzles to rotate synchronously in the forward direction or the reverse direction. When the multiple variable nozzles rotate synchronously in the forward direction (the opening direction), a passage area for (or a flow rate of) an exhaust gas to be supplied to the turbine impeller side is increased. On the other hand, the passage area is reduced when the multiple variable nozzles rotate synchronously in the reverse direction (the closing direction).

A support member is provided integrally on the opposite surface of the first base ring from the facing surface. The support member includes a cylindrical portion which houses the link mechanism. The support member further includes an outer edge portion (an outer flange) formed integrally with the cylindrical portion on one side in the aforementioned axial direction (the axial direction of the turbine impeller), and an inner edge portion (an inner flange) formed integrally with the cylindrical portion on the other side in the aforementioned axial direction. The outer edge portion protrudes radially outward, whereas the inner edge portion protrudes radially inward. The inner edge portion of the support member is integrally joined to the first base ring. The outer edge portion of the support member is sandwiched between a portion of the turbine housing on the one side in the aforementioned axial direction and a portion of the bearing housing on the other side in the aforementioned axial direction. With this sandwiching, the variable nozzle unit is disposed in the turbine housing.

While the variable geometry system turbocharger is in operation, heat from a nozzle ring flows into the inner edge portion (the inner flange) of the support member and the heat is absorbed from the outer edge portion (the outer flange) of the support member by the bearing housing. Accordingly, the temperature is relatively high in the inner edge portion of the support member, and relatively low in the outer edge portion (the outer flange) of the support member.

The conventional support member includes the cylindrical portion which houses the link mechanism in order to protect the link mechanism against the heat of the exhaust gas in the turbine scroll passage and thereby to sufficiently secure durability of the variably geometry system turbocharger. Due to the presence of the cylindrical portion, the shape of the support member tends to be complex. The complex shape of the support member makes temperature distribution in the support member complex while the variable geometry system turbocharger is in operation. For this reason, the support member is thermally deformed to a large degree during the operation. For instance, the support member is thermally deformed in such a way as to be pushed outward from the inner edge portion side. In this case, the deformation is large in the first base ring, whereby the parallelism between the facing surfaces of the first base ring and the second base ring is degraded. As a consequence, the interval between the facing surfaces of the first base ring and the second base ring is locally reduced.

In order to inhibit malfunctions such as non-smoothness of the multiple variable nozzles and to secure sufficient operational reliability of the variable nozzle unit (in other words, the variable geometry system turbocharger), a nozzle side clearance is usually set slightly larger. Thus, in the variable geometry system turbocharger in operation, a minimum interval between the facing surfaces of the first base ring and the second base ring is set greater than the width (the length in the aforementioned axial direction) of each variable nozzle. On the other hand, setting the slightly larger nozzle side clearance leads to an increase in a leak current from the nozzle side clearance, and thereby degrades turbine efficiency of the variable geometry system turbocharger. Here, the nozzle side clearance means either a gap between the facing surface of the first base ring and a side surface of the variable nozzle on the one side in the aforementioned axial direction or a gap between the facing surface of the second base ring and a side surface of the variable nozzle on the other side in the aforementioned axial direction.

SUMMARY OF THE INVENTION

In view of the above, it is an object of the present invention to provide a variable nozzle unit and a variable geometry system turbocharger, which are capable of improving the turbine efficiency of the variable geometry system turbocharger while securing the durability and reliability of the variable geometry system turbocharger.

A first aspect of the present invention is a variable geometry system turbocharger configured to supercharge air to be supplied to an engine by using energy of an exhaust gas from the engine. The variable geometry system turbocharger includes a variable nozzle unit which is disposed in a turbine housing by being sandwiched between (fastened by) the turbine housing and a bearing housing, and which is configured to adjust a passage area for (a flow rate of) the exhaust gas to be supplied to a turbine impeller. In the variable geometry system turbocharger, the variable nozzle unit includes: a first base ring disposed between a turbine scroll passage and the turbine impeller in the turbine housing, and concentrically with the turbine impeller; a second base ring provided at a position away from and opposed to the first base ring in an axial direction of the turbine impeller, and integrally with the first base ring; multiple variable nozzles disposed between facing surfaces of the first base ring and the second base ring, each variable nozzle being rotatable in forward and reverse directions (opening and closing directions) about a pivot parallel to a pivot of the turbine impeller; a link mechanism disposed on an opposite surface side of the first base ring from the facing surface thereof (on one side in the axial direction of the turbine impeller), and configured to cause the multiple variable nozzles to synchronously rotate in the opening and closing directions; and an annular support member provided integrally on the opposite surface of the first base ring from the facing surface thereof, the support member including an inner edge portion (an inner peripheral edge portion) integrally joined to the opposite surface of the first base ring from the facing surface thereof, and an outer edge portion (an outer peripheral edge portion) sandwiched by the turbine housing and the bearing housing. Furthermore, in the variable geometry system turbocharger, an annular container recessed portion configured to contain the link mechanism is formed in the bearing housing.

A second aspect of the present invention is a variable nozzle unit configured to adjust a passage area for (a flow rate of) an exhaust gas to be supplied to a turbine impeller side in a variable geometry system turbocharger. The variable nozzle unit includes: a first base ring disposed inside a turbine housing in the variable geometry system turbocharger and concentrically with the turbine impeller; a second base ring provided at a position away from and opposed to the first base ring in an axial direction of the turbine impeller, and integrated with the first base ring by using multiple connecting pins arranged in a circumferential direction of the base rings; multiple variable nozzles disposed between facing surfaces of the first base ring and the second base ring, each variable nozzle being rotatable in forward and reverse directions (opening and closing directions) about a pivot parallel to a pivot of the turbine impeller; a link mechanism disposed in a link chamber defined on an opposite surface (a side surface on one side in the axial direction of the turbine impeller) side of the first base ring from the facing surface thereof, and configured to cause the multiple variable nozzles to rotate synchronously; and a support member having a diameter greater than an outside diameter of the first base ring and being provided integrally on the opposite surface of the first base ring from the facing surface thereof. In this respect, the support member includes: an inner edge portion integrally joined to the opposite surface of the first base ring from the facing surface thereof with one end portions (one end portions in the axial direction of the turbine impeller) of the multiple connecting pins connected thereto; multiple joining pieces formed integrally on an inner peripheral surface of the support member in such a manner as to protrude radially inward at intervals in a circumferential direction of the support member, the joining pieces integrally joined to the opposite surface of the first base ring from the facing surface thereof; and an outer edge portion attached to a bearing housing of the variable geometry system turbocharger.

It is to be noted that "disposed" carries connotations of a state of being directly disposed and a state of being indirectly disposed through the intermediary of a different component. Further, "provided" carries connotations of a state of being directly provided and a state of being indirectly provided through the intermediary of a different component.

The present invention can thus provide the variable nozzle unit and the variable geometry system turbocharger, which are capable of improving the turbine efficiency of the variable geometry system turbocharger while securing the durability and reliability of the variable geometry system turbocharger.

DETAILED DESCRIPTION OF EMBODIMENTS

Figure 1A:
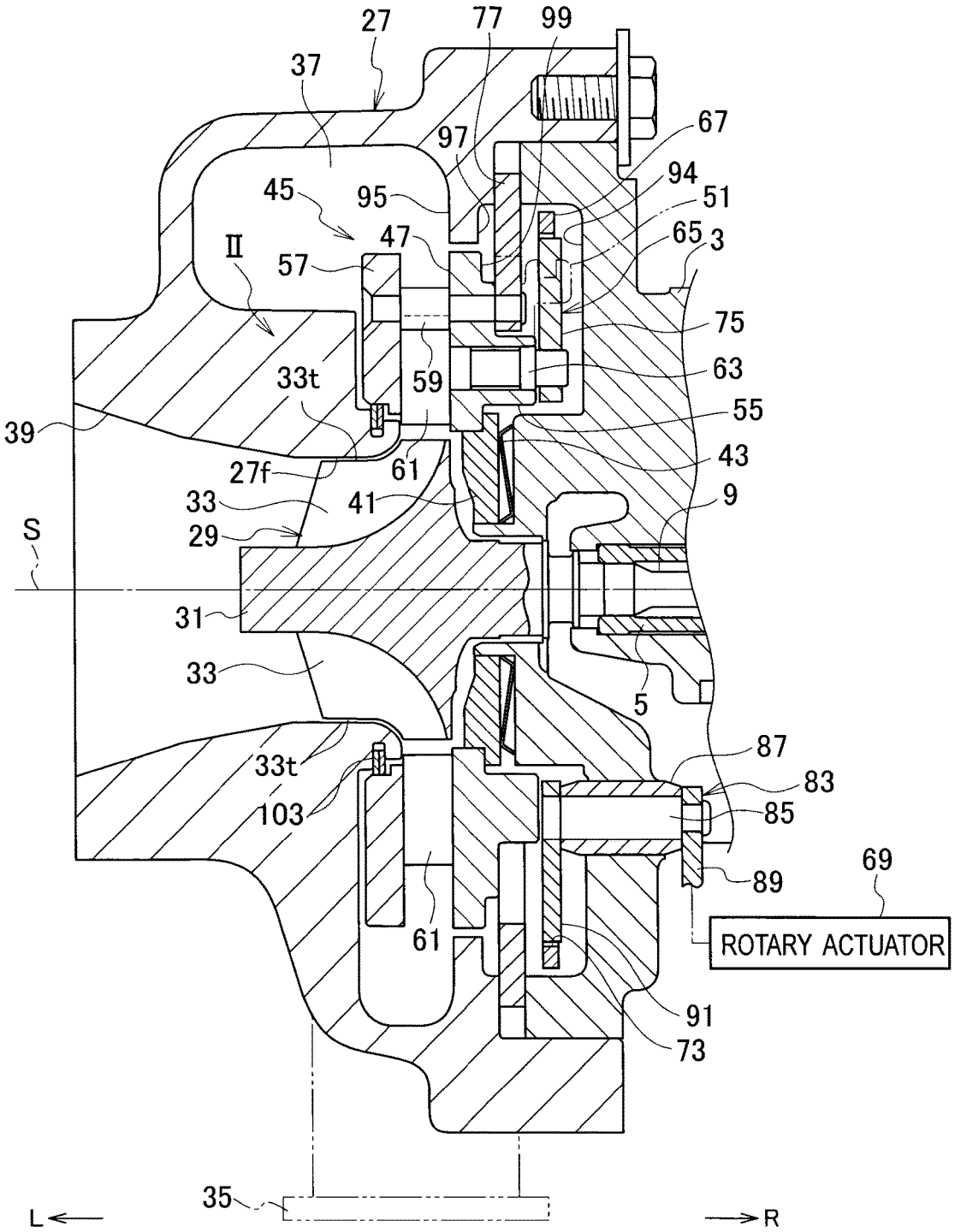
FIG. 1A is an enlarged view of a portion indicated with an arrow I in FIG. 7.

An embodiment of the present invention will be described below with reference to FIG. 1A to FIG. 7. In the drawings, the sign "R" indicates rightward while the sign "L" indicates leftward.

Figure 7:
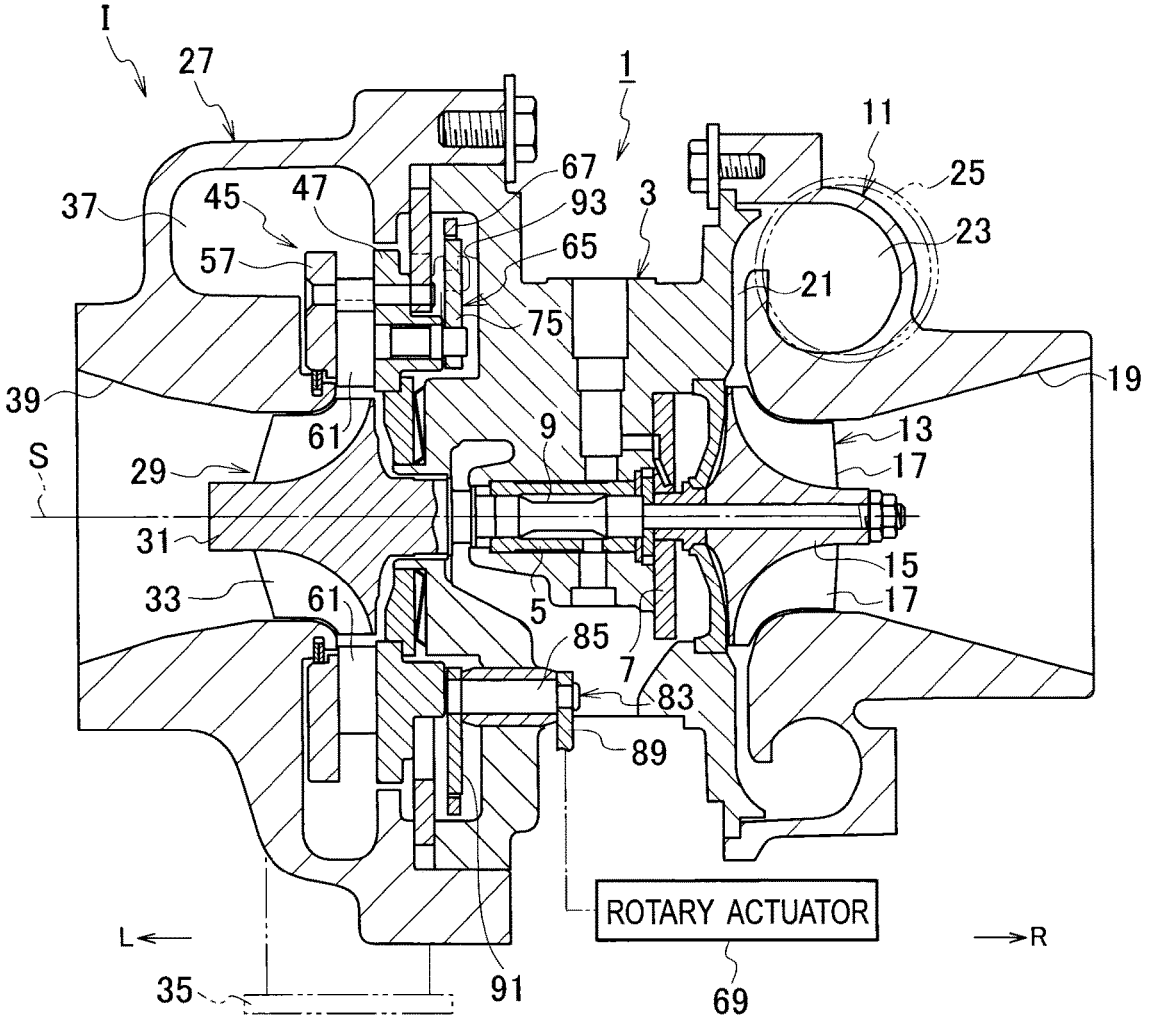
FIG. 7 is a front cross-sectional view of a variable geometry system turbocharger according to the embodiment of the present invention.

FIG. 7 is a cross-sectional view showing a variable geometry system turbocharger 1 according to the embodiment of the present invention. The variable geometry system turbocharger 1 supercharges (compresses) air to be supplied to an engine (not shown) by using energy of an exhaust gas from the engine.

The variable geometry system turbocharger 1 includes a bearing housing 3. A radial bearing 5 and a pair of thrust bearings 7 are provided inside the bearing housing 3. In addition, a rotor shaft (a turbine shaft) 9 extending in a right-left direction is rotatably provided to the multiple bearings 5 and 7. In other words, the rotor shaft 9 is rotatably provided in the bearing housing 3 by use of the multiple bearings 5 and 7.

A compressor housing 11 is provided on a right side of the bearing housing 3. A compressor impeller 13 is rotatably provided inside the compressor housing 11. The compressor impeller 13 rotates about its pivot S (in other words, a pivot of the rotor shaft 9) and compresses the air by use of centrifugal force generated by its rotation. The compressor impeller 13 includes a compressor wheel (a compressor disk) 15 which is integrally connected to a right end portion of the rotor shaft 9, and multiple compressor blades 17 provided on an outer peripheral surface of the compressor wheel 15 at equal intervals in a circumferential direction thereof.

The compressor housing 11 includes an air introduction port 19 for introducing the air, which is formed on an inlet side (an upstream side in a direction of an air flow) of the compressor impeller 13. The air introduction port 19 is connected to an air cleaner (not shown) configured to clean up the air. Meanwhile, an annular diffuser passage 21 configured to pressurize the compressed air is formed on an outlet side (a downstream side in the direction of the air flow) of the compressor impeller 13 between the bearing housing 3 and the compressor housing 11. Moreover, a compressor scroll passage 23 in a scroll shape is formed inside the compressor housing 11. The compressor scroll passage 23 communicates with the diffuser passage 21. In addition, an air emission port 25 configured to emit the compressed air is formed at an appropriate position in the compressor housing 11. The air emission port 25 communicates with the compressor scroll passage 23, and is connected to an air intake manifold (not shown) of the engine.

As shown in FIG. 1A and FIG. 7, a turbine housing 27 is provided on a left side of the bearing housing 3. A turbine impeller 29, which is configured to generate rotational force (rotational torque) by using pressure energy of the exhaust gas, is provided in the turbine housing 27 in such a manner as to be rotatable about a pivot S (a pivot of the turbine impeller 29, or the pivot of the rotor shaft 9). The turbine impeller 29 includes a turbine wheel (a turbine disk) 31 provided integrally in a left end portion of the rotor shaft 9, and multiple turbine blades 33 provided on an outer peripheral surface of the turbine wheel 31 at equal intervals in a circumferential direction thereof. Here, tip end edges 33*t* of the multiple turbine blades 33 are covered with a shroud wall 27*f* of the turbine housing 27.

As shown in FIG. 7, a gas introduction port 35 for introducing the exhaust gas is formed at an appropriate position in the turbine housing 27. The gas introduction port 35 is connectable to an air exhaust manifold (not shown) of the engine. Meanwhile, a turbine scroll passage 37 in a scroll shape is formed on an inlet side (an upstream side in a direction of an exhaust gas flow) of the turbine impeller 29 inside the turbine housing 27. The turbine scroll passage 37 communicates with the gas introduction port 35. Moreover, a gas emission port 39 for emitting the exhaust gas is formed on an outlet side (a downstream side in the direction of the exhaust gas flow) of the turbine impeller 29 in the turbine housing 27. The gas emission port 39 is connectable to an exhaust emission control system (not shown) configured to clean up the exhaust gas.

Figure 1B:
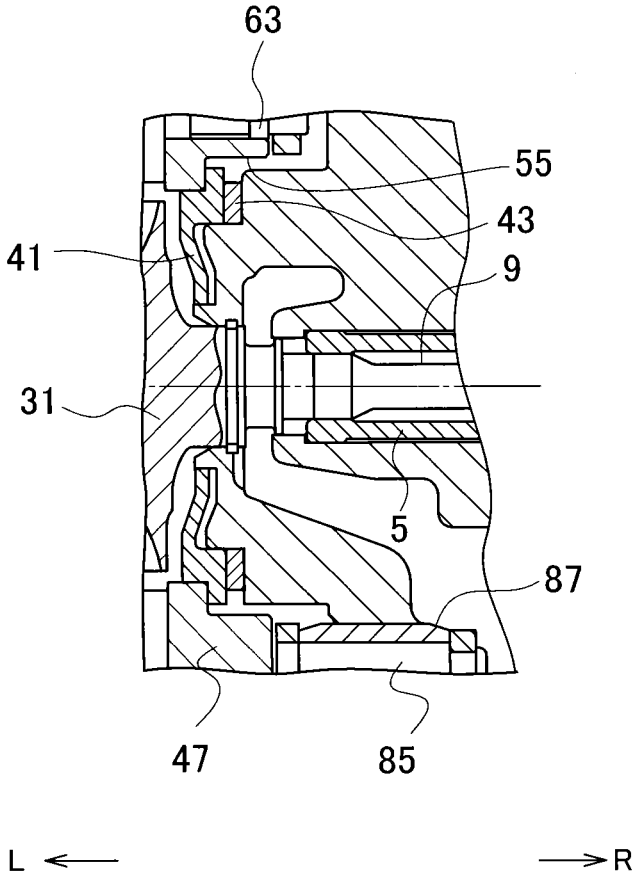
FIG. 1B is a view showing a modified example of an embodiment illustrated in FIG. 1A.

An annular heat shield plate 41 configured to block heat from the turbine impeller 29 side is provided on a left side surface of the bearing housing 3. A disk spring serving as a biasing member 43 is provided between the left side surface of the bearing housing 3 and a right side surface of the heat shield plate 41. Here, the biasing member 43 is not limited to the disk spring insofar as the biasing member 43 is designed to bias the left side surface of the bearing housing 3 against the heat shield plate 41. For example, the biasing member 43 may be a wave washer as shown in FIG. 1B.

The variable geometry system turbocharger 1 is equipped with a variable nozzle unit 45, which adjusts a passage area for (a flow rate of) the exhaust gas to be supplied to the turbine impeller 29. The variable nozzle unit 45 is disposed in the turbine housing 27 by being sandwiched (fastened) between the turbine housing 27 and the bearing housing 3.

Figure 5B:
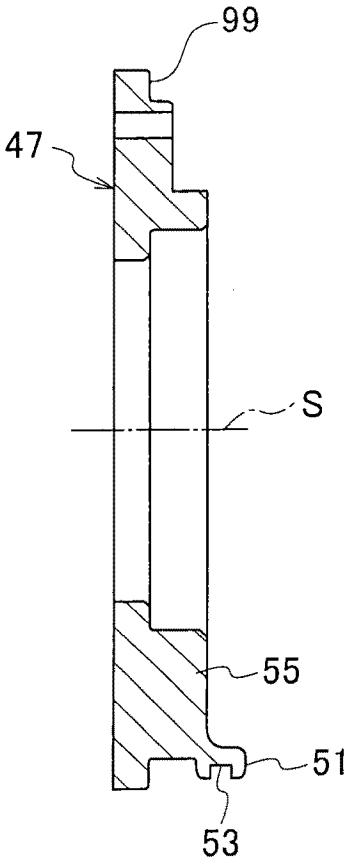
FIG. 5B is a cross-sectional view of the nozzle ring taken along the VB-VB line in FIG. 5A.
Figure 5A:
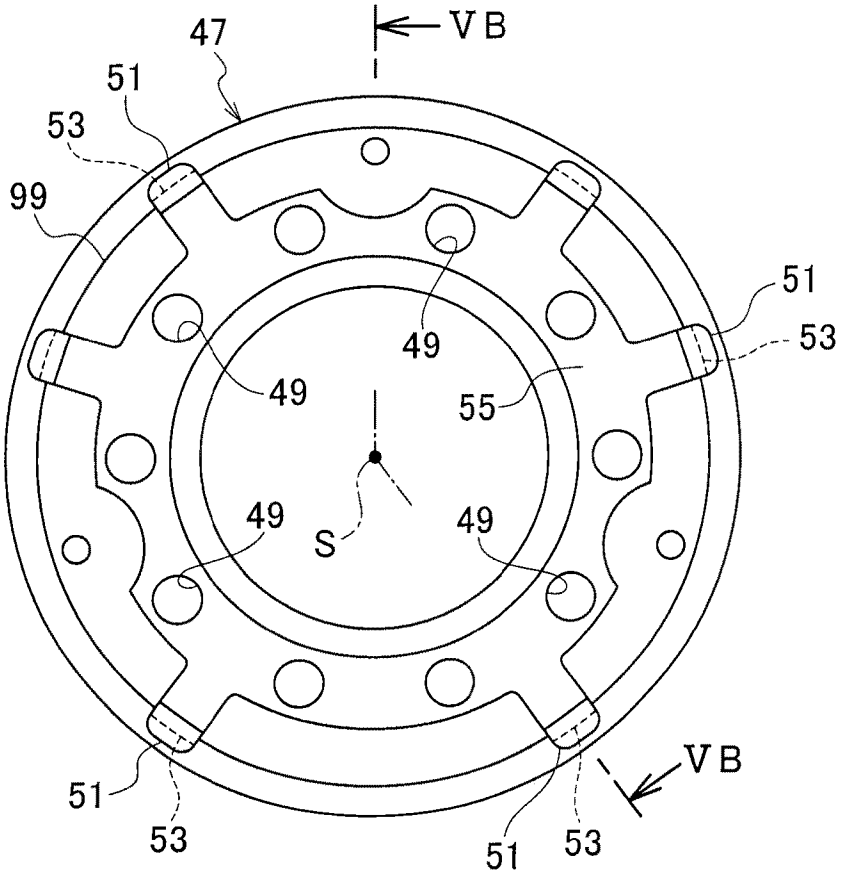
FIG. 5A is a view showing a nozzle ring in the variable nozzle unit according to the embodiment of the present invention.

A configuration of the variable nozzle unit 45 will be described. As shown in FIG. 1A, FIG. 5A, and FIG. 5B, a first nozzle ring 47 serving as a first base ring is disposed in the turbine housing 27. Specifically, the first nozzle ring 47 is disposed between the turbine scroll passage 37 and the turbine impeller 29 and concentrically with the turbine impeller 29. The first nozzle ring 47 includes multiple support holes 49 formed in a penetrating manner. The support holes 49 are arranged in a circumferential direction of the first nozzle ring 47. An inner edge portion of the first nozzle ring 47 is fitted to an outer edge portion (a step portion on an outer edge side) of the heat shield plate 41.

Multiple guide claws 51 are formed integrally on a right side surface of the first nozzle ring 47 (a side surface on one side in an axial direction of the turbine impeller 29). The guide claws 51 are located outside the support holes 49 in radial directions and arranged radially at intervals in the circumferential direction of the first nozzle ring 47. Each guide claw 51 includes a guide groove 53 having a U-shaped cross section, which is formed on a tip end side (radially outer side) of the guide claw 51. Furthermore, an annular connecting projecting portion 55, which protrudes rightward (toward the one side in the aforementioned axial direction), is formed on an inner edge portion (on an inner peripheral surface side) of the first nozzle ring 47 in such a manner as to connect base portions of the multiple guide claws 51 to one another.

As shown in FIG. 1A, a second nozzle ring 57 serving as a second base ring is provided at a position, which is away from the first nozzle ring 47 in a right-left direction (the aforementioned axial direction) and is opposed to the first nozzle ring 47. The second nozzle ring 57 is provided integrally and concentrically with the first nozzle ring 47 by means of multiple (three or more) connecting pins 59 arranged in the circumferential direction of the second nozzle ring 57. Here, the multiple connecting pins 59 define a clearance between a facing surface (a side surface on the other side in the aforementioned axial direction) of the first nozzle ring 47 and a facing surface (a side surface on the one side in the aforementioned axial direction) of the second nozzle ring 57. Here, as shown in Patent Documents 1 and 2 cited above, the second nozzle ring 57 may include a shroud portion to cover the tip end edges 33*t* of the multiple turbine blades 33.

Figure 2:
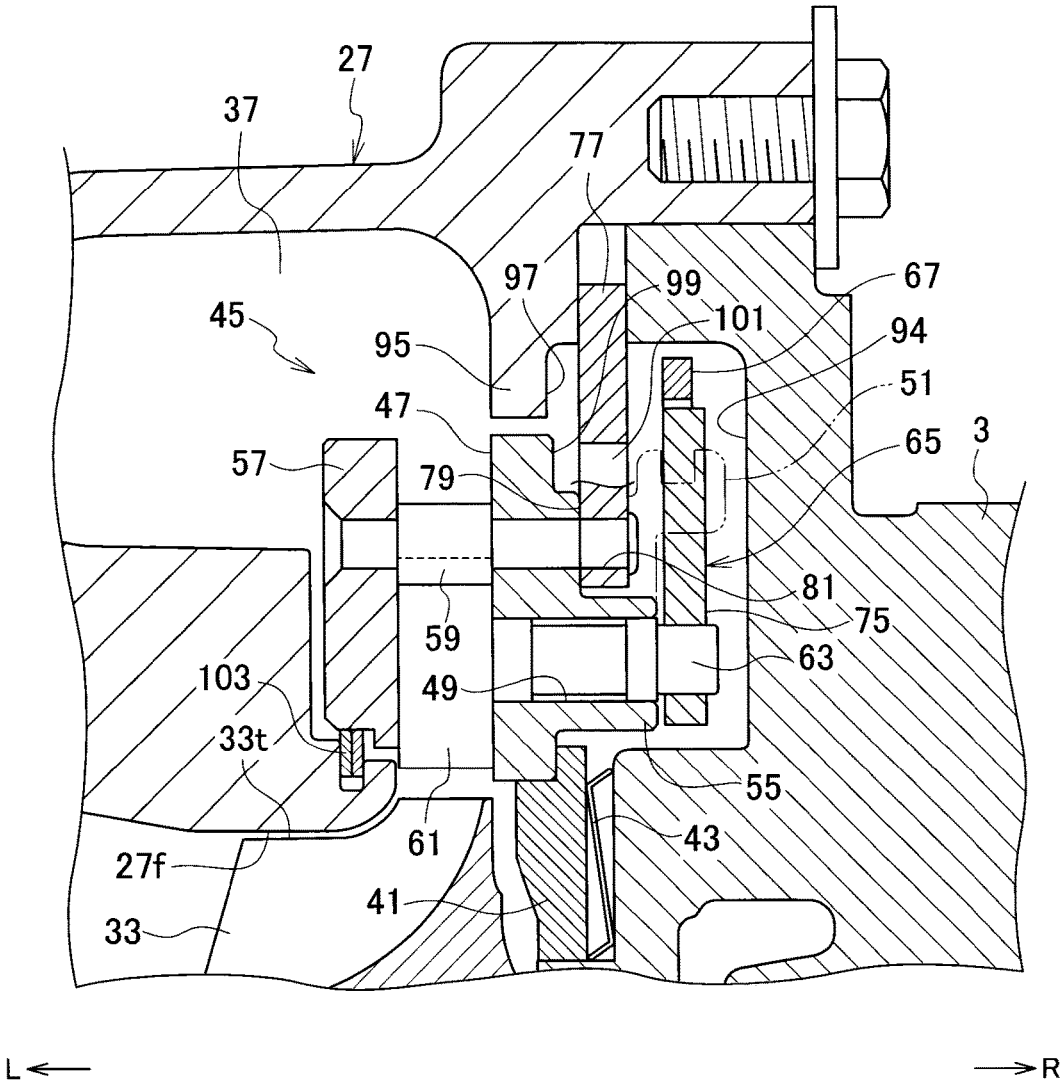
FIG. 2 is an enlarged view of a portion indicated with an arrow II in FIG. 1A.

As shown in FIG. 2, multiple variable nozzles 61 are disposed between the facing surfaces of the first nozzle ring 47 and the second nozzle ring 57 in such a manner as to surround the turbine impeller 29. In the embodiment, intervals of the multiple variable nozzles 61 are set constant in the circumferential direction. However, such intervals do not always have to be constant in consideration of the shapes and other factors of the individual variable nozzles 61. Each variable nozzle 61 is provided to be rotatable in a forward direction or a reverse direction (in an opening direction or a closing direction) about its pivot which is parallel to the pivot S of the turbine impeller 29. In addition, a nozzle shaft 63 is formed integrally on a right side surface (a side surface on the one side in the aforementioned axial direction) of each variable nozzle 61. Each nozzle shaft 63 is rotatably supported by a corresponding support hole 49 provided in the first nozzle ring 47. Moreover, stopper pins (not shown) are provided at appropriate positions between the facing surfaces of the first nozzle ring 47 and the second nozzle ring 57. The stopper pins (not shown) restrain rotation of the multiple variable nozzles 61 in the forward direction (or the reverse direction) beyond predetermined rotational positions. In the embodiment, each variable nozzle 61 is supported by the first nozzle ring 47 with the assistance of the nozzle shaft 63. However, another nozzle shaft (not shown) may be formed integrally on a left side surface (a side surface on the other side in the aforementioned axial direction) of each variable nozzle 61 and such another nozzle shaft may be rotatably supported by another corresponding support hole (not shown) in the second nozzle ring 57.

A link mechanism 65 is disposed on an opposite surface side (the one side in the aforementioned axial direction) of the first nozzle ring 47 from the facing surface. The link mechanism 65 is connected to the nozzle shafts 63 of the multiple variable nozzles 61, and causes the multiple variable nozzles 61 to rotate synchronously in the forward direction or the reverse direction (the opening direction or the closing direction).

Figure 3:
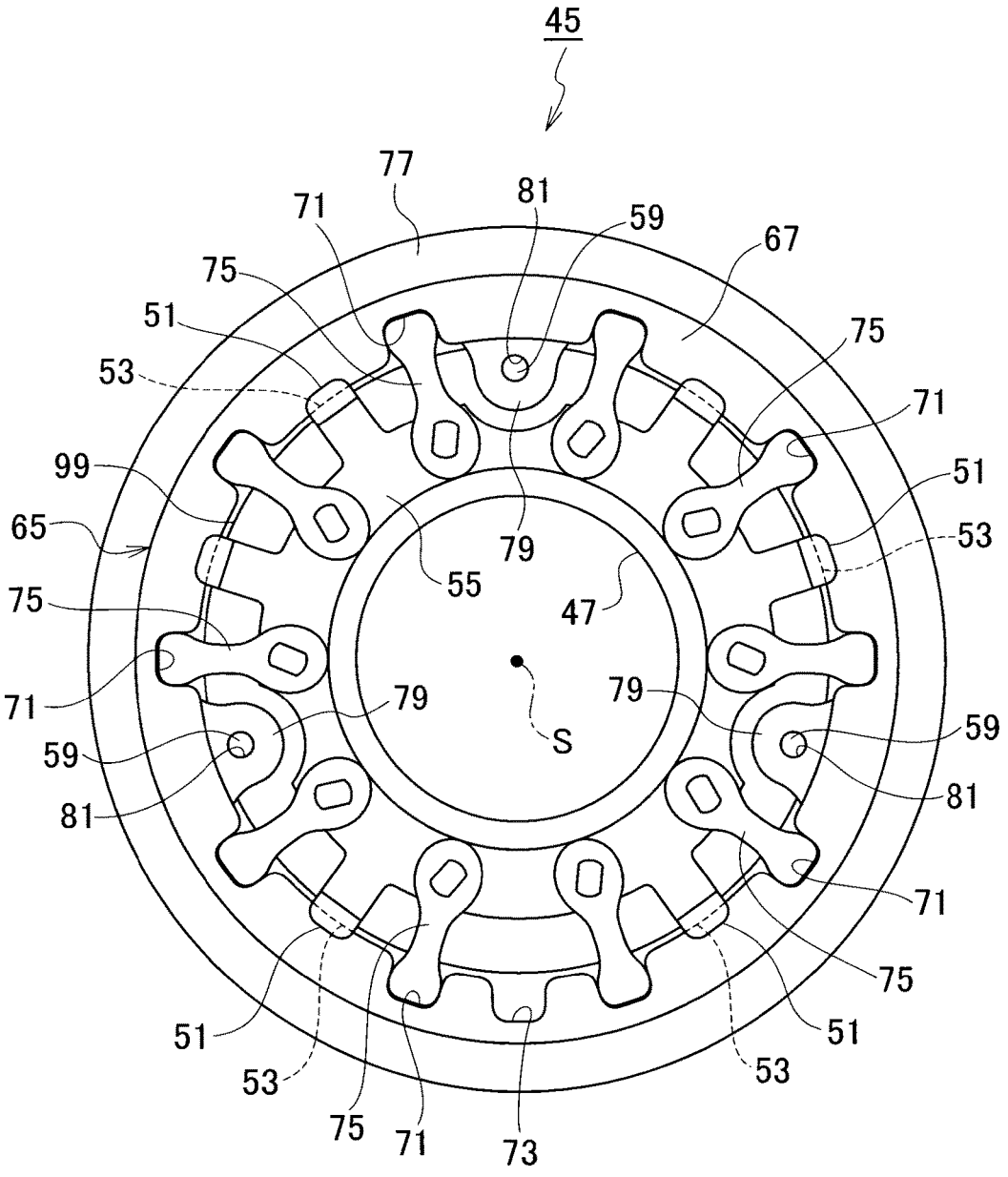
FIG. 3 is a view showing part of a variable nozzle unit according to the embodiment of the present invention.

A specific configuration of the link mechanism 65 will be described. As shown in FIG. 2 and FIG. 3, a drive ring 67 is guided and supported by the guide grooves 53 of the multiple guide claws 51 of the first nozzle ring 47 in such a manner as to be rotatable in the forward and reverse directions (in the opening and closing directions) about the pivot S of the turbine impeller 29 (the pivot of the first nozzle ring 47). The drive ring 67 rotates in the forward direction or the reverse direction by drive of a rotary actuator 69 such as an electric motor or a negative pressure cylinder. In addition, engagement recessed portions (engagement portions) 71 are formed in an inner edge portion of the drive ring 67. The engagement recessed portions 71 retreats radially outward in the drive ring 67. The engagement recessed portions 71 are as many as the variable nozzles 61. Another engagement recessed portion (another engagement portion) 73, which retreats radially outward, is formed at an appropriate position in the inner edge portion of the drive ring 67. In addition, base portions of synchronous link members (nozzle link members) 75 are integrally connected to the nozzle shafts 63 of the variable nozzles 61. A tip end portion of each synchronous link member 75 is engaged with the corresponding engagement recessed portion 71 in the drive ring 67. Here, as disclosed in Patent Documents 1 and 2, the drive ring 67 may be supported rotatably in the forward direction or the reverse direction by a guide ring (not shown) provided on the opposite surface of the first nozzle ring 47 from the facing surface, instead of being supported rotatably in the forward direction or the reverse direction by the guide grooves 53.

As shown in FIG. 2, a support member (a support ring) 77 is provided integrally on the opposite surface (the side surface on the one side in the aforementioned axial direction) of the first nozzle ring 47 from the facing surface. The support ring 77 is formed in an annular shape and its outside diameter is greater than the outside diameter of the first nozzle ring 47. An inner edge portion of the support ring 77 is integrally joined to the opposite surface of the first nozzle ring 47 from the facing surface by means of swaging using right end portions (one end portions) of the multiple connecting pins 59.

Multiple joining pieces 79 to be integrally joined to the opposite surface of the first nozzle ring 47 from the facing surface are formed integrally on an inner peripheral surface of the support member 77. The multiple joining pieces 79 protrude radially inward and are provided at intervals in the circumferential direction of the support member 77. Each joining piece 79 is provided with an insertion hole 81 in a penetrating manner to allow insertion of a left end portion of the corresponding connecting pin 59. As will be described later, the joining pieces 79 may be joined only to joining projecting portions 93.

An outer edge portion of the support member 77 is sandwiched between a right side portion (the one side portion in the aforementioned axial direction) of the turbine housing 27 and a left side portion (the other end portion in the aforementioned axial direction) of the bearing housing 3. For example, the outer edge portion of the support member 77 is attached to the bearing housing 3 in the state of being sandwiched in conjunction with the turbine housing 27. As a consequence of the attachment of the outer edge portion of the support member 77 to the bearing housing 3, the variable nozzle unit 45 is disposed inside the turbine housing 27. In other words, the outer edge portion of the support member 77 is fixed between the facing surfaces of the turbine housing 27 and the bearing housing 3, whereby the variable nozzle unit 45 is disposed in the turbine housing 27. Regarding the fixation of the outer edge portion of the support member 77, the outer edge portion may be attached to the bearing housing 3 by using attachment bolts (not shown).

As shown in FIG. 1A, a drive mechanism 83 for operating the link mechanism 65 is provided at the left side portion of the bearing housing 3.

A specific configuration of the drive mechanism 83 will be described. A drive shaft 85 is provided on a left side portion of the bearing housing 3 through the intermediary of a bush 87. The drive shaft 85 is rotatably provided about its pivot which is parallel to the pivot of the turbine impeller 29. A right end portion (one end portion) of the drive shaft 85 is connected to the rotary actuator 69 through a power transmission member 89. Meanwhile, a base end portion of a drive link member 91 is integrally connected to a left end portion (the other end portion) of the drive shaft 85. A tip end portion of the drive link member 91 is engaged with the other engagement recessed portion (the other engagement portion) 73 of the drive ring 67.

As shown in FIG. 1A and FIG. 2, an annular container recessed portion 94 for containing the link mechanism 65 is formed at the left side portion (the left side surface) of the bearing housing 3.

A protection wall 95 is provided radially outside the first nozzle ring 47 inside the turbine housing 27. The protection wall 95 is formed annularly and integrally with the turbine housing 27, and is configured to protect the support member 77 against heat of the exhaust gas in the turbine scroll passage 37. Meanwhile, an annular recessed step portion 97 is formed on an inner edge side of a right side surface of the protection wall 95 of the turbine housing 27. In other words, the protection wall 95 includes a side surface contacting to the support member 77, and the side surface of the protection wall 95 includes the annular recessed step portion 97 formed on the inner edge side thereof.

An annular recessed step portion 99 is formed on an outer edge side of the facing surface of the first nozzle ring 47 from the opposite surface. The recessed step portion 99 allows only the multiple joining pieces 79 in the support member 77 to come into contact with the first nozzle ring 47. Here, each of the protection wall 95, the recessed step portion 97, and the recessed step portion 99 is formed in the annular shape which is continuous in the circumferential direction. However, any of the protection wall 95, the recessed step portion 97, and the recessed step portion 99 may be formed in an annular shape which is discontinuous in the circumferential direction. Meanwhile, multiple recessed step portions (not shown) each having an arc shape may be formed instead of the annular recessed step portion 99 being formed on the outer edge side of the opposite surface of the first nozzle ring 47 from the facing surface.

Figure 6B:
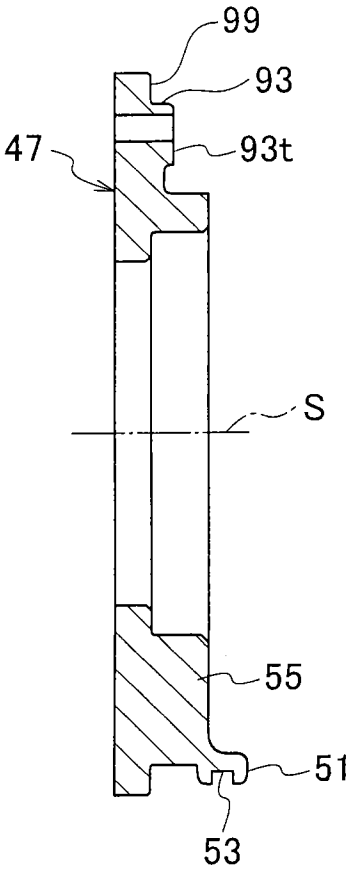
FIG. 6B is a cross-sectional view of the modified example taken along the VIB-VIB line in FIG. 6A.
Figure 6A:
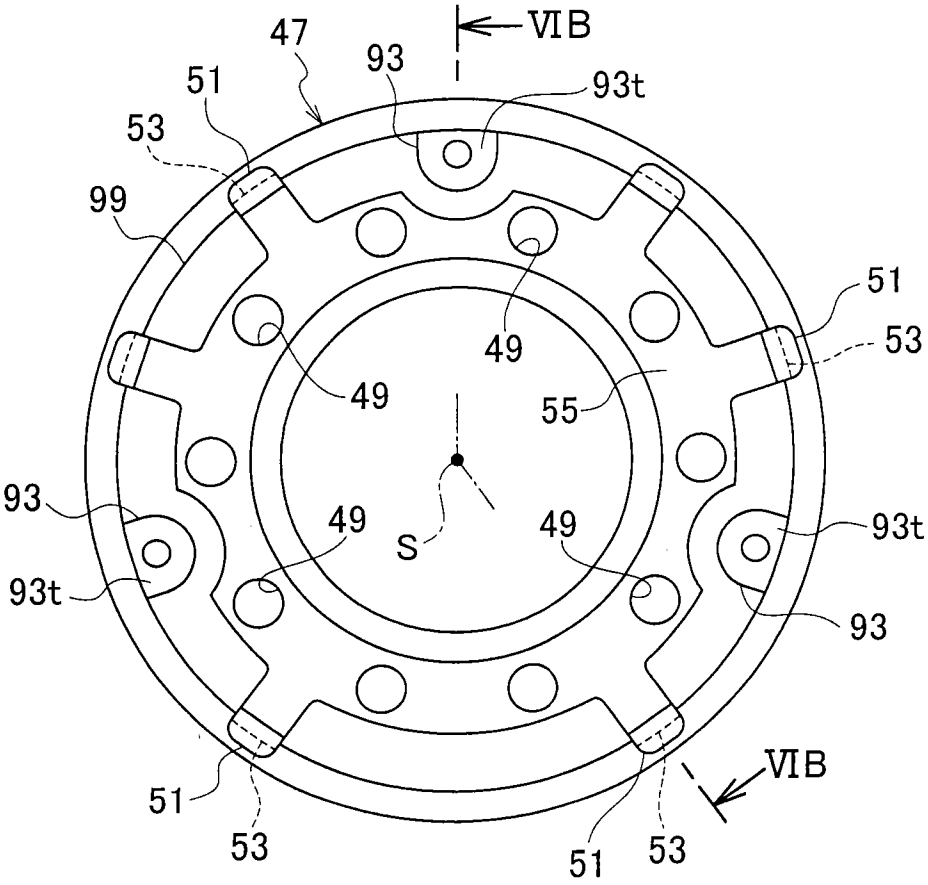
FIG. 6A is a view showing a modified example of the nozzle ring shown in FIG. 5A.

As shown in FIG. 6A and FIG. 6B, multiple joining projecting portions (joining land portions) 93 may be formed on the opposite surface of the first nozzle ring 47 from the facing surface. The joining projecting portions 93 are formed at intervals in the circumferential direction of the first nozzle ring 47 in such a manner as to protrude rightward (toward the one side in the aforementioned axial direction). A top surface 93*t* of each joining projecting portion 93 is a machined surface subjected to machining. The top surface 93*t* of each joining projecting portion 93 of the first nozzle ring 47 is joined to the corresponding joining piece 79 of the support member 77.

Figure 4B:
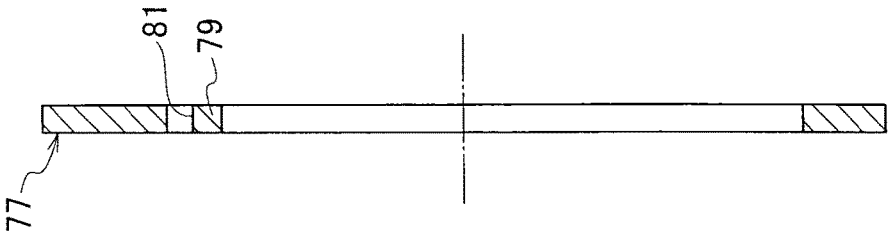
FIG. 4B is a cross-sectional view of the variable nozzle unit taken along the IVB-IVB line in FIG. 4A.
Figure 4A:
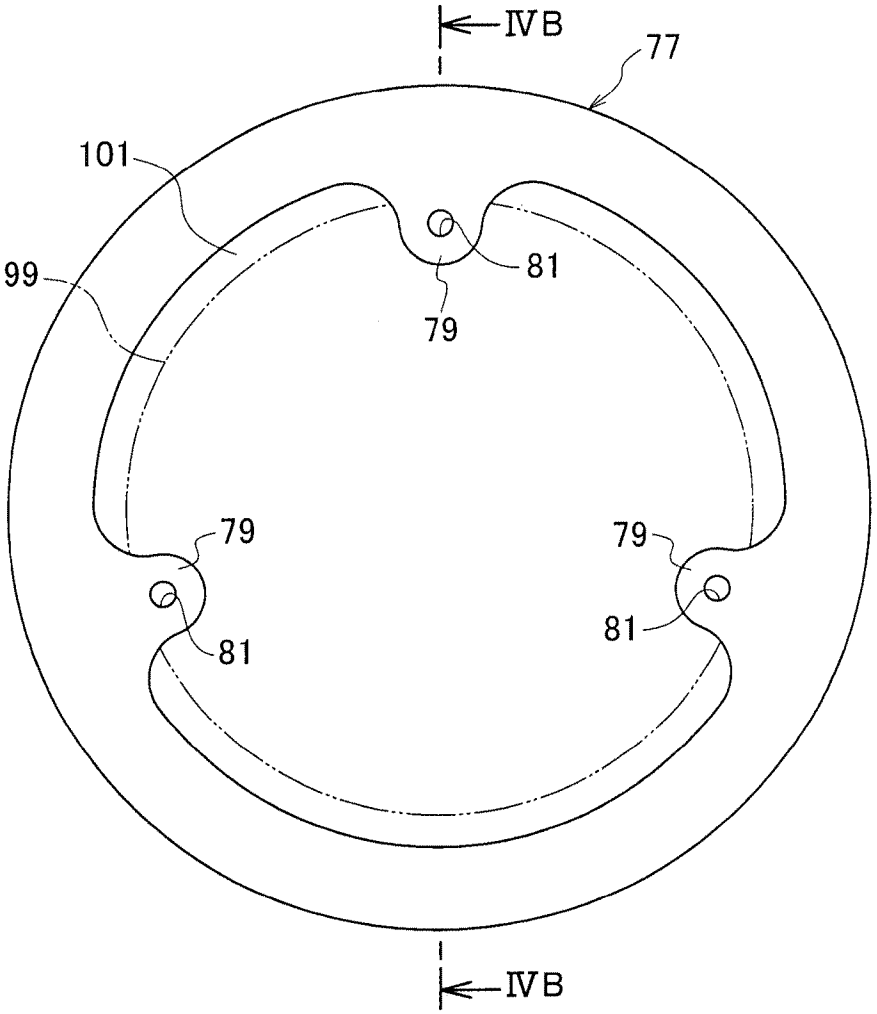
FIG. 4A is a view showing a support member in the variable nozzle unit according to the embodiment of the present invention.

As shown in FIG. 2 and FIG. 4A, a connecting passage 101 in a discontinuous annular shape is formed between each pair of the joining pieces 79 that are adjacent in the circumferential direction on the inside (on an inner peripheral surface side) of the support member 77. The connecting passage 101 makes the turbine scroll passage 37 and the container recessed portion 94 of the bearing housing 3 communicate with each other. Here, instead of or in addition to the formation of the connecting passage 101 between the joining pieces 79 that are adjacent in the circumferential direction on the inside of the support member 77, a connecting hole (not shown) in any of a circular, rectangular, or slit-like shape may be formed in a penetrating manner which makes the turbine scroll passage 37 and the container recessed portion 94 of the bearing housing 3 communicate with the support member 77.

Meanwhile, as shown in FIG. 1A and FIG. 2, multiple seal rings 103 are provided between an inner peripheral surface of the second nozzle ring 57 and a certain position in the turbine housing 27. The seal rings 103 suppress leakage of the exhaust gas from the opposite surface side of the second nozzle ring 57 from the facing surface.

Next, operations and effects of the embodiment of the present invention will be described.

The exhaust gas introduced from the gas introduction port 35 is fed from the inlet side to the outlet side of the turbine impeller 29 through the turbine scroll passage 37. Thus, the rotational force (the rotational torque) is generated by using the pressure energy of the exhaust gas. The rotor shaft 9 and the compressor impeller 13 can be rotated integrally with the turbine impeller 29 by using the generated rotational force. This makes it possible to compress the air introduced from the air introduction port 19 and to emit the air from the air emission port 25 through the diffuser passage 21 and the compressor scroll passage 23. Thus, it is possible to supercharge (compress) the air to be supplied to the engine.

While the variable geometry system turbocharger 1 is in operation, if the number of revolutions of the engine is in a high revolution range and a flow rate of the exhaust gas is accordingly high, the drive shaft 85 is rotated in one direction by the drive of the rotary actuator 69, whereby the drive ring 67 is rotated in the forward direction while causing the drive link member 91 to swing in the one direction. Thus, it is possible to cause the multiple variable nozzles 61 to synchronously rotate in the forward direction (the opening direction) while causing the multiple synchronous link members 75 to swing in the forward direction, and thereby to increase the aperture of the multiple variable nozzles 61. As a consequence, it is possible to increase the passage area for (the flow rate of) the exhaust gas to be supplied to the turbine impeller 29 side, and to supply a large amount of the exhaust gas to the turbine impeller 29 side.

If the number of revolutions of the engine is in a low revolution range and the flow rate of the exhaust gas is accordingly low, the drive shaft 85 is rotated in the other direction by the drive of the rotary actuator 69, whereby the drive ring 67 is rotated in the reverse direction while causing the drive link member 91 to swing in the other direction. Thus, it is possible to cause the multiple variable nozzles 61 to synchronously rotate in the reverse direction, and thereby to reduce the aperture of the multiple variable nozzles 61. As a consequence, it is possible to reduce the passage area for (the flow rate of) the exhaust gas to be supplied to the turbine impeller 29 side, to increase a flow speed of the exhaust gas, and thereby to secure a sufficient workload of the turbine impeller 29.

In addition to the operations stated above, the annular container recessed portion 94 to contain the link mechanism 65 is formed on the left side portion of the bearing housing 3. This configuration enables the support member 77 to protect the link mechanism 65 against the heat of the exhaust gas in the turbine scroll passage 37 without forming the support member 77 into a complex shape with a cylindrical portion. In other words, the support member 77 formed in a simple shape can have simple temperature distribution while the variable geometry system turbocharger 1 is in operation. This makes it possible to reduce a thermal deformation of the support member 77 while the variable geometry system turbocharger 1 is in operation, and to reduce a deformation of the first nozzle ring 47 in association therewith.

The multiple joining pieces 79 are formed integrally on the inner peripheral surface of the support member 77 at intervals in the circumferential direction, and the annular recessed step portion 99 is formed on the outer edge side of the facing surface of the first nozzle ring 47 from the opposite surface. Thus, it is possible to reduce heat transmission areas of the support member 77 and the first nozzle ring 47.

The annular recessed step portion 97 is formed on the inner edge side of the right side surface of the protection wall 95 of the turbine housing 27. Thus, it is possible to reduce heat transmission areas of the support member 77 and the turbine housing 27.

The multiple joining pieces 79 are formed integrally on the inner peripheral surface of the support ring 77 in such a manner as to protrude radially inward and at intervals in the circumferential direction. Further, the top surface 93*t* of each joining projecting portion 93 of the first nozzle ring 47 is joined to the corresponding joining piece 79 of the support ring 77. Thus, it is possible to reduce the heat transmission areas of the support member 77 and the first nozzle ring 47.

As a consequence of at least any one of the above-described reductions in the heat transmission areas, it is possible to suppress a rise in temperature of the support member 77 while the variable geometry system turbocharger 1 is in operation, and thereby to minimize a thermal deformation of the support member 77 and a deformation of the first nozzle ring 47 in association therewith.

The connecting passage 101 in the discontinuous annular shape for making the turbine scroll passage 37 and the container recessed portion 94 of the bearing housing 3 communicate with each other is formed between each pair of the joining pieces 79 that are adjacent in the circumferential direction inside the support member 77. Thus, while the variable geometry system turbocharger 1 is in operation, a pressure inside the container recessed portion 94 of the bearing housing 3 can be increased whereby each variable nozzle 61 can be shifted to the facing surface side of the second nozzle ring 57.

According to the embodiment, the support member 77 can protect the link mechanism 65 against the heat of the exhaust gas in the turbine scroll passage 37. In addition, it is possible to minimize a thermal deformation of the support member 77 and a deformation of the first nozzle ring 47 while the variable geometry system turbocharger 1 is in operation. Thus, a nozzle side clearance can be made as small as possible, and sufficient parallelism can be secured between the facing surfaces of the first nozzle ring 47 and the second nozzle ring 57 while the variable geometry system turbocharger 1 is in operation. As a consequence, it is possible to inhibit malfunctions such as non-smoothness of the multiple variable nozzles 61, to sufficiently secure durability and operational reliability of the variable geometry system turbocharger 1 (the variable nozzle unit 45), to reduce a leak current from the nozzle side clearance, and thus to improve turbine efficiency of the variable geometry system turbocharger 1. Note that the nozzle clearance means either a gap between the facing surface of the first nozzle ring 47 and the right side surface of each variable nozzle 61, or a gap between the facing surface of the second nozzle ring 57 and the left side surface of each variable nozzle 61.

In particular, since the variable nozzles 61 can be shifted to the facing surface side of the second nozzle ring 57 while the variable geometry system turbocharger 1 is in operation, it is possible to suppress a leak current from the gap between the left side surface of each variable nozzle 61 and the facing surface of the second nozzle ring 57, to stabilize flows of the exhaust gas along the tip end edge 33*t* side portions (portions from a mid-span side toward the tip end edge 33*t* side) of the turbine blades 33, and to further improve the turbine efficiency of the variable geometry system turbocharger 1.

Note that the present invention is not limited only to the descriptions of the embodiment stated above but can also be embodied in various other modes. It is to be also understood that the scope of rights encompassed by the present invention are not limited to these embodiments.

The invention claimed is:

1. A variable geometry system turbocharger configured to supercharge air to be supplied to an engine by using energy of an exhaust gas from the engine, comprising:

a variable nozzle unit disposed in a turbine housing by being sandwiched between the turbine housing and a bearing housing, and configured to adjust a passage area for the exhaust gas to be supplied to a turbine impeller, and an annular container recessed portion formed in the bearing housing to contain a link mechanism, wherein the variable nozzle unit includes:

a first base ring disposed between a turbine scroll passage and the turbine impeller in the turbine housing, and concentrically with the turbine impeller;

a second base ring provided at a position away from and opposed to the first base ring in an axial direction of the turbine impeller, and integrally with the first base ring;

a plurality of variable nozzles disposed between facing surfaces of the first base ring and the second base ring, each variable nozzle being rotatable in forward and reverse directions about a pivot parallel to a pivot of the turbine impeller;

the link mechanism disposed on an opposite surface side of the first base ring from the facing surface thereof, the link mechanism including link members linking with the corresponding variable nozzles and a drive ring engaged with the link members to cause the plurality of variable nozzles to synchronously rotate in opening and closing directions via the link members;

a support member provided integrally on the opposite surface of the first base ring from the facing surface thereof, the support member including an inner edge portion integrally joined to the opposite surface of the first base ring from the facing surface thereof, and an outer edge portion sandwiched by the turbine housing and the bearing housing; and a connecting passage formed on an inner side of the support member and configured to make the turbine scroll passage and the container recessed portion of the bearing housing communicate with each other.

2. The variable geometry system turbocharger according to claim 1, further comprising a plurality of joining pieces formed integrally on an inner peripheral surface of the support member in such a manner as to protrude radially inward at intervals in a circumferential direction of the support member, the joining pieces integrally joined to the opposite surface of the first base ring from the facing surface thereof.

3. The variable geometry system turbocharger according to claim 1, further comprising an annular protection wall formed radially outside the first base ring inside the turbine housing, and configured to protect the support member against heat from the exhaust gas in the turbine scroll passage.

4. The variable geometry system turbocharger according to claim 3, wherein the protection wall includes a side surface contacting to the support member, and the side surface of the protection wall includes an annular recessed step portion formed on an inner edge side thereof.

5. A variable nozzle unit configured to adjust a passage area for an exhaust gas to be supplied to a turbine impeller in a variable geometry system turbocharger, comprising:

a first base ring disposed inside a turbine housing in the variable geometry system turbocharger and concentrically with the turbine impeller;

a second base ring provided at a position away from and opposed to the first base ring in an axial direction of the turbine impeller, and integrated with the first base ring by using a plurality of connecting pins arranged in a circumferential direction of the base rings;

a plurality of variable nozzles disposed between facing surfaces of the first base ring and the second base ring, each variable nozzle being rotatable in forward and reverse directions about a pivot parallel to a pivot of the turbine impeller;

a link mechanism disposed in a link chamber formed on an opposite surface side of the first base ring from the facing surface thereof, and configured to cause the plurality of variable nozzles to rotate synchronously; and a support member having a diameter greater than an outside diameter of the first base ring and being provided integrally on the opposite surface of the first base ring from the facing surface thereof, the support member including an inner edge portion integrally joined to the opposite surface of the first base ring from the facing surface thereof with one end portions of the plurality of connecting pins connected thereto, a plurality of joining pieces formed integrally on an inner peripheral surface of the support member in such a manner as to protrude radially inward at intervals in a circumferential direction of the support member, the joining pieces integrally joined to the opposite surface of the first base ring from the facing surface thereof, and an outer edge portion attached to a bearing housing of the variable geometry system turbocharger.

6. The variable nozzle unit according to claim 5, further comprising a recessed step portion formed on an outer edge side of the opposite surface of the first base ring from the facing surface thereof.

7. The variable nozzle unit according to claim 5, further comprising a plurality of joining projecting portions formed on the opposite surface of the first base ring from the facing surface thereof at intervals in the circumferential direction of the base rings in such a manner as to protrude toward the one side in the axial direction of the turbine impeller, wherein a top surface of each joining projecting portion is joined to the corresponding joining piece of the support member.

8. The variable nozzle unit according to claim 5, further comprising a connecting passage formed on an inner side of the support member between the joining pieces adjacent in the circumferential direction of the support member, and configured to make a turbine scroll passage of the turbine housing and the link chamber communicate with each other.

9. A variable geometry system turbocharger configured to supercharge air to be supplied to an engine by using energy of an exhaust gas from the engine, comprising:

a variable nozzle unit configured to adjust a passage area for an exhaust gas to be supplied to a turbine impeller, the variable nozzle unit including:

a first base ring disposed inside a turbine housing in the variable geometry system turbocharger and concentrically with the turbine impeller;

a second base ring provided at a position away from and opposed to the first base ring in an axial direction of the turbine impeller, and integrated with the first base ring by using a plurality of connecting pins arranged in a circumferential direction of the base rings;

a plurality of variable nozzles disposed between facing surfaces of the first base ring and the second base ring, each variable nozzle being rotatable in forward and reverse directions about a pivot parallel to a pivot of the turbine impeller;

a link mechanism disposed in a link chamber formed on an opposite surface side of the first base ring from the facing surface thereof, and configured to cause the plurality of variable nozzles to rotate synchronously; and a support member having a diameter greater than an outside diameter of the first base ring and being provided integrally on the opposite surface of the first base ring from the facing surface thereof, the support member including an inner edge portion integrally joined to the opposite surface of the first base ring from the facing surface thereof with one end portions of the plurality of connecting pins connected thereto, a plurality of joining pieces formed integrally on an inner peripheral surface of the support member in such a manner as to protrude radially inward at intervals in a circumferential direction of the support member, the joining pieces integrally joined to the opposite surface of the first base ring from the facing surface thereof, and an outer edge portion attached to a bearing housing.

* * * * *